US007984820B2

(12) United States Patent
Dancyger

(10) Patent No.: US 7,984,820 B2
(45) Date of Patent: Jul. 26, 2011

(54) CONTAINER WITH REMOVABLE DIVIDERS

(75) Inventor: Michael Dancyger, Los Angeles, CA (US)

(73) Assignee: Custom Leathercraft Manuf. Co, Inc., South Gate, CA (US)

( * ) Notice: Subject to any disclaimer, the term of this patent is extended or adjusted under 35 U.S.C. 154(b) by 641 days.

(21) Appl. No.: 11/451,859

(22) Filed: Jun. 13, 2006

(65) Prior Publication Data

US 2007/0284376 A1 Dec. 13, 2007

(51) Int. Cl.
*B65D 25/04* (2006.01)

(52) U.S. Cl. ..... 220/532; 220/500; 220/528; 220/533

(58) Field of Classification Search ..... 220/500, 220/528, 532, 533
See application file for complete search history.

(56) References Cited

U.S. PATENT DOCUMENTS

| | | | | | |
|---|---|---|---|---|---|
| 464,544 | A * | 12/1891 | Wood | 220/532 |
| 2,985,333 | A * | 5/1961 | Kirkman | 220/533 |
| 3,554,429 | A * | 1/1971 | Cohen | 229/120.34 |
| 3,726,411 | A * | 4/1973 | Jones | 211/126.13 |
| 4,436,215 | A * | 3/1984 | Kleinert et al. | 220/533 |
| 4,741,438 | A * | 5/1988 | Mastronardo et al. | 206/308.1 |
| 4,776,481 | A * | 10/1988 | Kidd | 220/532 |
| 5,482,342 | A * | 1/1996 | Kowalski et al. | 294/160 |
| 5,715,968 | A * | 2/1998 | Fink et al. | 220/669 |
| 6,196,647 | B1 * | 3/2001 | Kupferschmid | 312/9.48 |
| 2003/0089294 | A1 * | 5/2003 | Biemiller | 114/343 |
| 2003/0160052 | A1 * | 8/2003 | Mulaw | 220/532 |

* cited by examiner

*Primary Examiner* — Anthony Stashick
*Assistant Examiner* — Elizabeth Volz

(57) ABSTRACT

A container with removable dividers. The container includes a bottom wall, four side walls, one pair of opposed side walls comprising pairs of channels formed thereon, and a plurality of removable dividers receivable in pairs of channels. The dividers include a notch formed at a top of a body portion to enable easy placement and removal of the dividers in the container having a handle.

8 Claims, 4 Drawing Sheets

CONTAINER WITH REMOVABLE DIVIDERS

BACKGROUND OF THE INVENTION

The present invention relates generally to containers, and more particularly, to containers with removable dividers and to systems for removably partitioning the interior of containers.

It is well known to provide a divider in a container for the purpose of defining compartments in the interior of the container. Using dividers allows items carried in the container to be separated and protected one from the other and prevents the intermixing of the divided items within the container. Conventional dividers include removable inserts which conform to the shape of the interior of the container and sliding dividers for adjustably partitioning the interior of the container.

One problem with known dividers is that the dividers do not accommodate a container handle and are difficult to place in, and remove from, is the container. This is particularly true in cases where the container handle is formed of a rigid material and cannot be moved to accommodate the divider.

Known dividers also suffer the disadvantage of moving within the container to undesirable locations. Such movement may adversely impact the items stored within the container.

There is therefore a need for a container with removable dividers that overcomes the limitations of the prior art. There is also a need for a container with removable dividers wherein the dividers are configured to be easily placed in, and removed from, the container. There is a further need for a container with removable dividers wherein the dividers are securely held within the container.

SUMMARY OF THE INVENTION

The present invention provides a container with removable dividers having a notch formed proximate the top of the dividers to facilitate the placement and removal of the dividers in the container. The container further includes a system of channels for accepting positioning rods formed at the edges of the dividers. Insertion of the positioning rods within the channels secures the dividers within the container.

In accordance with one aspect of the invention, a container with removable dividers includes a bottom wall, four side walls, one pair of opposed side walls comprising pairs of channels formed thereon, and a plurality of removable dividers receivable in pairs of channels.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of design and to the sequence of steps set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent methods and systems insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings.

DETAILED DESCRIPTION OF THE INVENTION

Figure 1:
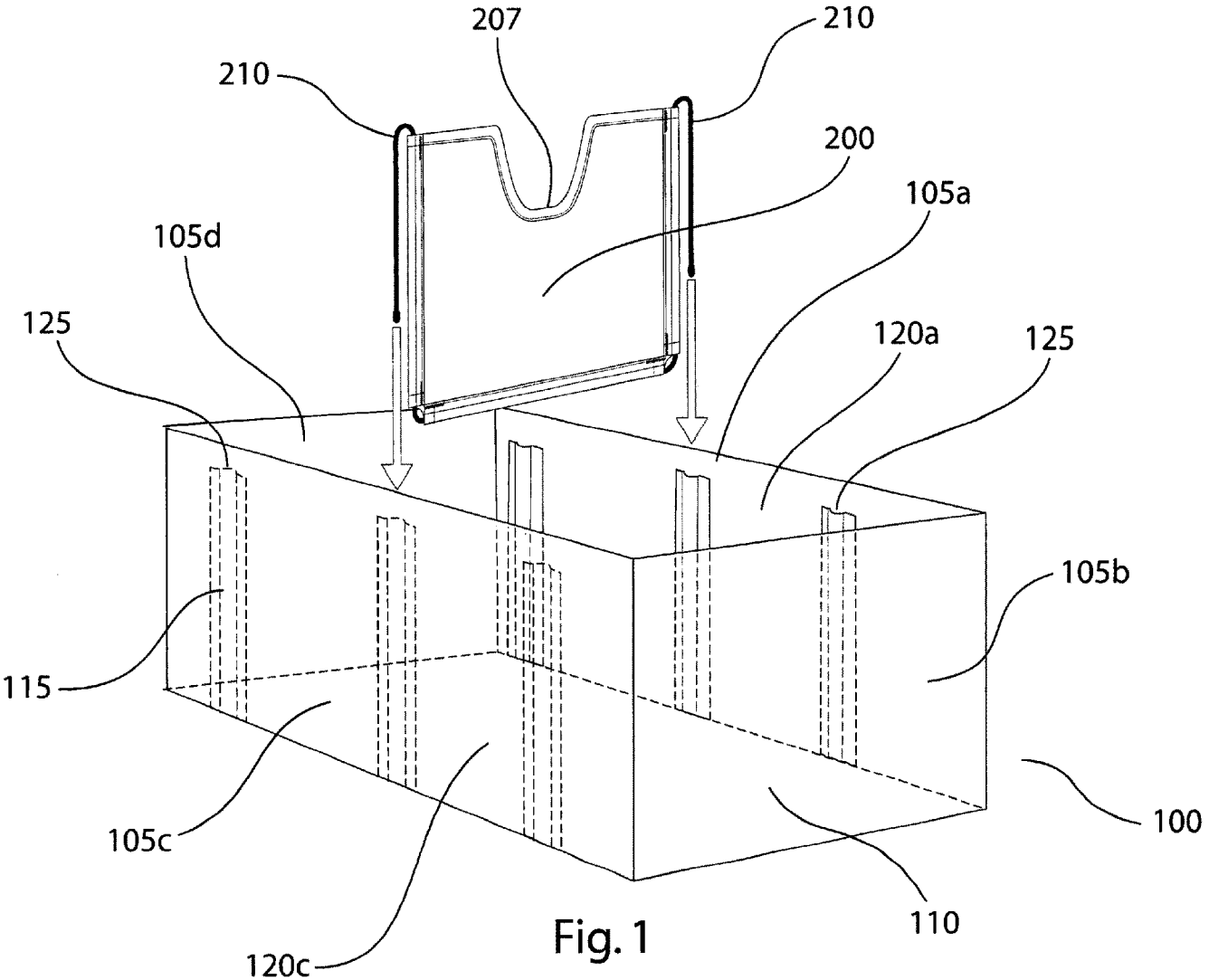
FIG. 1 is a schematic representation of a container with removable dividers in accordance with the invention.
Figure 2:
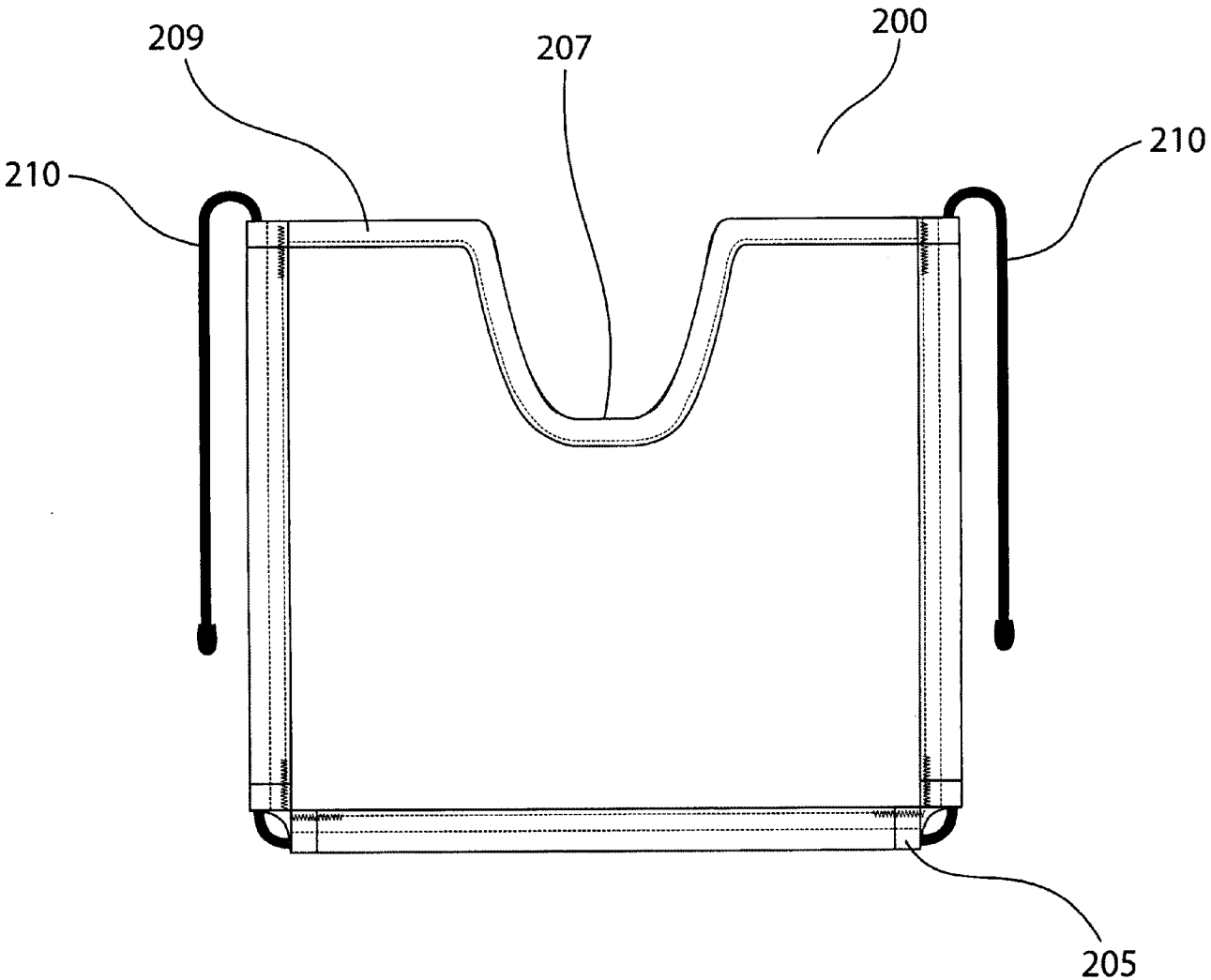
FIG. 2 is a side elevation view of a divider in accordance with the invention.

With reference to FIG. 1 and FIG. 2, a container with removable dividers generally designated 100 includes four side walls 105*a*, 105*b*, 105*c* and 105*d* and a bottom wall 110. A plurality of pairs of channels 115 are formed on opposite interior surfaces 120*a* and 120*c* of side walls 105*a* and 105*c* respectively. Channels 115 include a receptacle or slot 125 sized and configured to receive a positioning rod 210 and to secure a divider 200 therewithin.

Container 100 may be fabricated of any suitable material including metal, leather, plastic, and canvas. Channels 115 may be fabricated of the same or a different material and may be formed on the side walls 105*a* and 105*c* by any suitable means including sewing, gluing, and welding.

Dividers 200 include a body portion 205 of a configuration conforming to the configuration of the interior of the container 100. A notch 207 is formed proximate a top 209 of the body portion 205 and extends approximately one third of the length of the body portion 205. Notch 207 facilitates the placement of the divider 200 in the container 100 as further described herein. Dividers 200 may be formed of any suitable material including wire form and plastic.

Positioning rods 210 extend laterally and downwardly from the top 209 of the body portion 205. The lateral extension of the positioning rods 210 provides a clearance to enable the positioning rods 210 to be received in slots 125. The downwardly extension of the positioning rods 210 provides accommodation of the positioning rods 210 within the slots 125 to thereby hold the dividers 200 in position within the container. Positioning rods 210 may be formed of any suitable material including metal and plastic.

Figure 3:
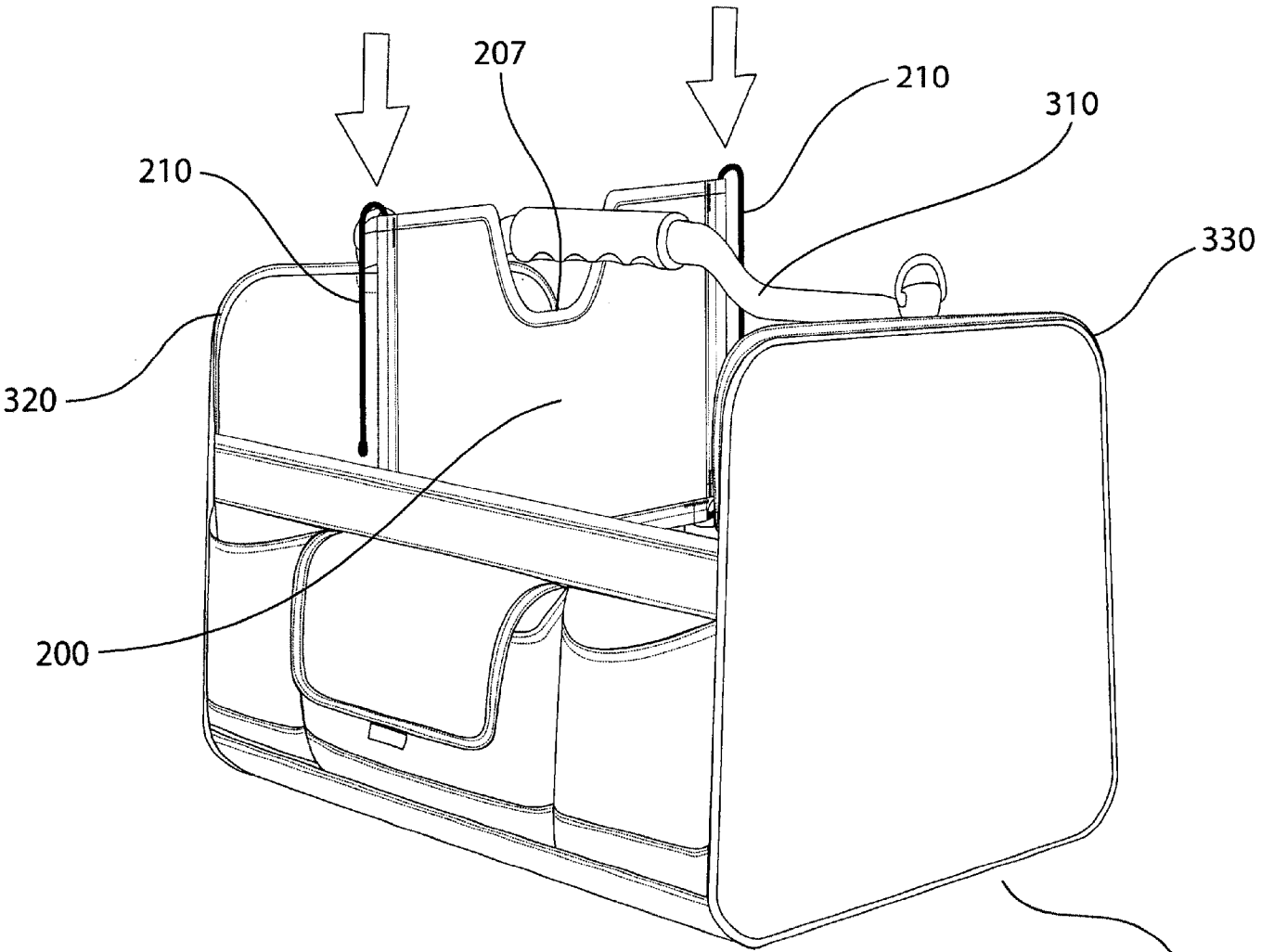
FIG. 3 is a perspective view of the container with removable dividers showing placement of a divider within the container in accordance with the invention.
Figure 4:
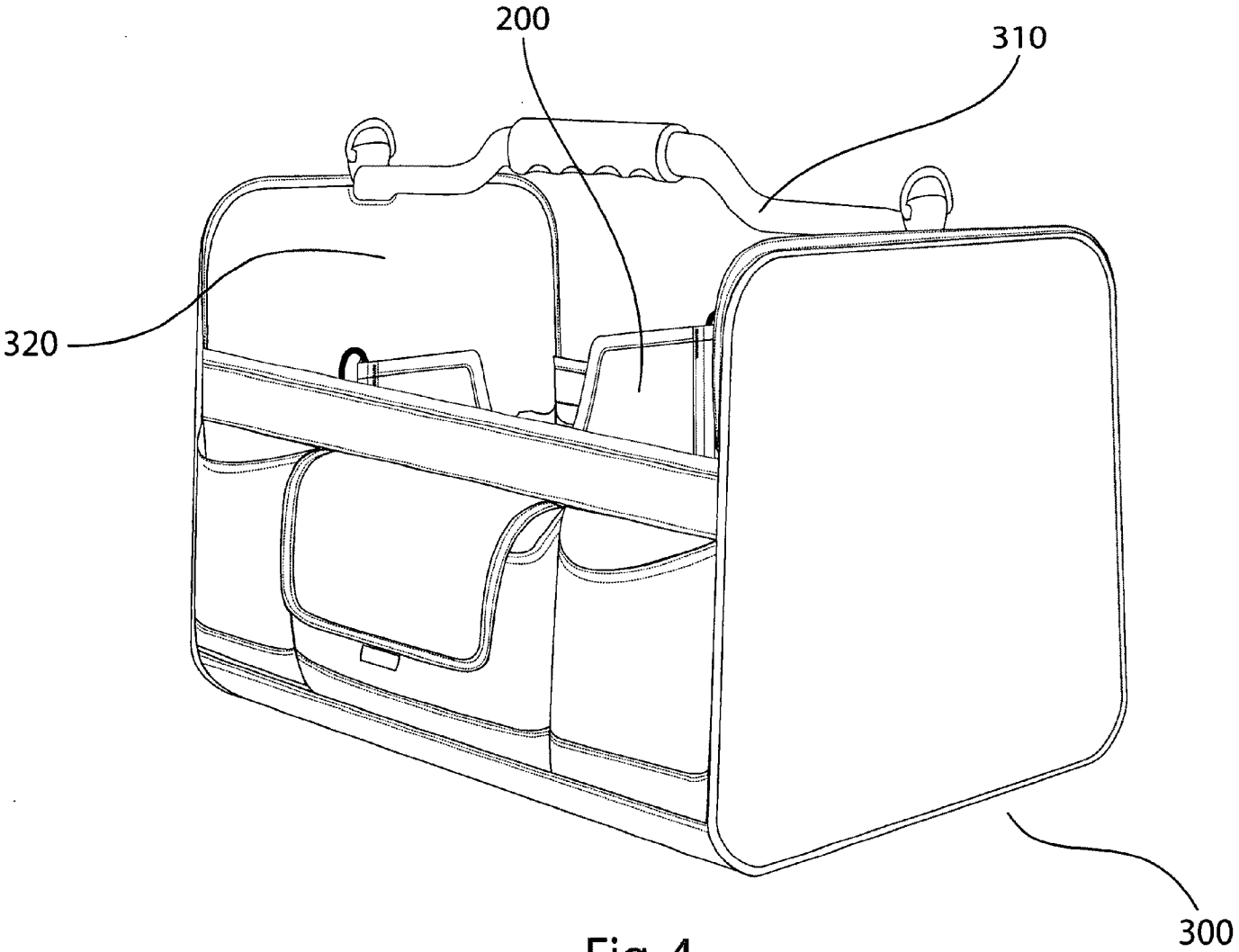
FIG. 4 is a perspective view of the container with removable dividers showing the divider placed within the container in accordance with the invention.

With reference to FIG. 3, a container 300 in accordance with the invention includes channels (not shown) such as channels 115 having slots 125. Container 300 is shown including a handle 310 extending from a first side 320 to a second side 330 of the container 300. Notch 207 enables the divider 200 to clear the handle 310 so that the positioning rods 210 can be positioned in the channels (not shown). Divider 200 is shown secured within the container 300 to partition an interior 340 of the container 300 in FIG. 4.

The container with removable dividers of the present invention provides dividers having notches formed proximate the top of the dividers to facilitate the placement and removal of the dividers in a container having a handle. The dividers are securely held within the container to provide partitions which do not shift during use of the container to thereby protect items held within the container. The dividers are easily removed from the container to create partitions of various sizes within the container.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A container comprising:

a bottom wall;

a pair of opposed side walls comprising pairs of side wall channels formed thereon;

a first end wall and a second end wall coupled to the bottom wall;

a handle having a first end coupled to the first end wall and a second end coupled to the second end wall;

a plurality of removable dividers receivable in pairs of side wall channels, each of the plurality of removable dividers including:

a notch formed at a top of a body portion;

a formed portion for holding side portions of a positioning rod on opposing ends of the body portion, wherein the side portions of the positioning rod are parallel to end portions of the positioning rod; and a bottom portion for coupling a central section of the positioning rod, wherein the positioning rod includes a u-shaped portion disposed in each removable divider, and the side portions of the positioning rod is surrounded by the formed portion on opposing ends of the body portion, and the central section of the positing rod is surrounded by the bottom portion.

2. The container of claim 1, wherein the container including an interior portion, and the plurality of dividers are movable to configure varying divided portions therein.

3. The container of claim 1, wherein the dividers are made of canvas.

4. The container of claim 1, wherein the side channels each form a slot extending therein.

5. The container of claim 4, wherein all of the length of the end portions of the positioning rod are receivable in the slots.

6. A tool bag comprising:

a bottom wall;

a pair of opposed side walls comprising pairs of side wall channels formed thereon;

a first end wall and a second end wall coupled to the bottom wall;

a handle having a first end coupled to the first end wall and a second end coupled to the second end wall;

a plurality of removable dividers receivable in pairs of side wall channels, each of the plurality of removable dividers including:

a notch formed at a top of a body portion;

a formed portion for holding side portions of a positioning rod on opposing ends of the body portion, wherein the side portions of the positioning rod are parallel to end portions of the positioning rod; and a bottom portion for coupling a central section of the positioning rod, wherein the positioning rod includes a u-shaped portion disposed within each removable divider.

7. A carry bag comprising:

a bottom wall;

a pair of opposed side walls comprising pairs of side wall slots formed thereon;

a first end wall and a second end wall coupled to the bottom wall;

a handle having a first end coupled to the first end wall and a second end coupled to the second end wall;

at least one removable divider receivable in pairs of slots, the removable divider including:

a notch formed at a top of a body portion;

a formed portion for holding side portions of a positioning rod on opposing ends of the body portion, wherein the side portions of the positioning rod are parallel to end portions of the positioning rod; and a bottom portion for coupling a central section of the positioning rod, wherein the positioning rod includes a u-shaped portion disposed within each removable divider.

8. The carry bag of claim 7, wherein the formed portion comprises canvas.

* * * * *